US007300959B2

(12) United States Patent
Vogt et al.

(10) Patent No.: US 7,300,959 B2
(45) Date of Patent: Nov. 27, 2007

(54) FISCHER-TROPSCH PROCESS USING A FISCHER-TROPSCH CATALYST AND ZEOLITE Y

(75) Inventors: Eelco Titus Carel Vogt, Culemborg (NL); Johannes Petrus Jozef Verlaan, Deventer (NL); Marieke Paulyne Renate Spee, Utrecht (NL)

(73) Assignee: Albemarle Netherlands B.V., Amersfoort (NL)

( * ) Notice: Subject to any disclaimer, the term of this patent is extended or adjusted under 35 U.S.C. 154(b) by 0 days.

(21) Appl. No.: 10/533,830

(22) PCT Filed: Oct. 30, 2003

(86) PCT No.: PCT/EP03/12164

§ 371 (c)(1),
(2), (4) Date: Apr. 10, 2006

(87) PCT Pub. No.: WO2004/041969

PCT Pub. Date: May 21, 2004

(65) Prior Publication Data

US 2006/0223893 A1 Oct. 5, 2006

(30) Foreign Application Priority Data

Nov. 5, 2002 (EP) ..... 02079645

(51) Int. Cl.
*C07C 27/00* (2006.01)

(52) U.S. Cl. ..... 518/719; 518/700; 518/715

(58) Field of Classification Search ..... 518/700, 518/715, 719

See application file for complete search history.

(56) References Cited

U.S. PATENT DOCUMENTS

| | | | |
|---|---|---|---|
| 4,294,725 | A | 10/1981 | Fraenkel et al. |
| 4,556,645 | A | 12/1985 | Coughlin et al. |
| 4,632,941 | A | 12/1986 | Coughlin |
| 4,652,538 | A | 3/1987 | Rabo et al. |

FOREIGN PATENT DOCUMENTS

| | | |
|---|---|---|
| EP | 0 247 679 | 12/1989 |
| GB | 2211201 | 6/1989 |
| WO | WO 01/26811 | 4/2001 |

OTHER PUBLICATIONS

Lin et al., Iron alloy Fischer-Tropsch catalyst versus iron-cobalt on Y-zeolite, (Journal of catalysis (1986), 97 (1), 177-87.*

Tatsumi et al , Bifunctional and hybrid catalysts for selective Fischer-Tropsch synthesis, (Pro. International Conference, Coal Science , (1985), 323-326).*

* cited by examiner

*Primary Examiner*—J. Parsa
(74) *Attorney, Agent, or Firm*—Frank C. Eymard

(57) ABSTRACT

Fischer-Tropsch process for the conversion of carbon monoxide and hydrogen to $C_5^+$ hydrocarbon mixtures in which process use is made of Fischer-Tropsch catalyst particles and particles comprising zeolite Y with a water adsorption capacity (25° C., $p/p_0$=0.20) of at least 16 wt %.

7 Claims, No Drawings

FISCHER-TROPSCH PROCESS USING A FISCHER-TROPSCH CATALYST AND ZEOLITE Y

The present invention relates to a Fischer-Tropsch process for the conversion of carbon monoxide and hydrogen to $C_5^+$ hydrocarbon mixtures, using a Fischer-Tropsch catalyst and zeolite Y.

The Fischer-Tropsch process generally comprises the following process steps. The first step involves reacting a source of carbon (such as coal or natural gas) with a source of oxygen (such as steam, air or oxygen) to form a mixture of carbon monoxide and hydrogen, usually referred to as synthesis gas.

The second step involves contacting the carbon monoxide and hydrogen with a Fischer-Tropsch catalyst leading to hydrocarbons and water. Depending on the process conditions and the catalyst used, the nature of the hydrocarbons and the chain length may vary. The main products of the Fischer-Tropsch reaction are linear olefins and paraffins and water, but limited isomerisation and inclusion of heteroatoms such as oxygen may occur. Generally applied catalysts for this second step are iron and/or cobalt-containing catalysts. In order to enhance isomerisation during this second step, a co-catalyst can be added.

The third step involves isomerisation of the hydrocarbons formed in the second step to produce more valuable products. For instance, the longer chains in the product may be cracked to form products in the diesel or gasoline range, and linear paraffins may be isomerised to improve diesel product properties such as cloud point and pour point. Generally, adapted hydrotreating catalysts are used for this third step.

U.S. Pat. No. 4,632,941 discloses the use in a Fischer-Tropsch process of a catalyst composition comprising a physical mixture of an iron and/or cobalt-containing catalyst component and a steam-stabilised, hydrophobic zeolite Y, also known as ultra hydrophobic zeolite Y (UHP-Y). This UHP-Y has a water adsorption capacity (WAC), measured at $p/p_0$=0.10 and 25° C., of less than 10 wt %.

This ultra hydrophobic zeolite Y was prepared by extensive steaming of low sodium zeolite Y, as described in GB-A 2 014 970. According to this patent application, this extensive steaming involves calcining the zeolite in an environment comprising from about 0.2 to 10 atmospheres of steam at a temperature of from 725 to 870° C. for several hours.

Such an extensive steaming step makes the ultrahydrophobic zeolite Y rather expensive.

It is an object of the present invention to provide a Fischer-Tropsch process using a system of a Fischer-Tropsch catalyst and a less expensive and easier to prepare zeolite Y. It is a further object to provide a system of a Fischer-Tropsch catalyst and zeolite Y which is more polar, thereby being suitable to be used for the conversion of more polar feeds, i.e. Fischer-Tropsch process streams rich in oxygenates.

The process according to the invention uses Fischer-Tropsch catalyst particles and particles comprising zeolite Y with a water adsorption capacity (WAC), measured at 25° C. and $p/p_0$=0.2, of at least 16 wt %.

The preparation of such a zeolite Y does not require excessive steaming.

This zeolite Y preferably has a WAC of 17-35 wt %, more preferably 17-25 wt %, and most preferably 17-20 wt %.

The WAC is determined as follows. The zeolite is pretreated in order to dry the material for 3 hours at 425° C., after which the weight of the materials is determined. The dried material is then equilibrated at 25° C. and a partial water vapour pressure of $p/p_0$=0.20, after which the weight is measured again. The WAC is the percentage of weight increase as a result of this equilibration.

The catalyst composition can be prepared by simply mixing existing Fischer-Tropsch catalyst particles and particles comprising the zeolite Y. Its preparation does not require industrially undesired impregnation steps.

In one embodiment, the Fischer-Tropsch catalyst particles and the particles comprising zeolite Y may be used in the form of shaped bodies in which both particles are embedded. Examples of shaped bodies are spray-dried particles (microspheres), extrudates, pellets, spheres, etc.

Such shaped bodies can be prepared by shaping a physical mixture of Fischer-Tropsch catalyst particles and particles comprising zeolite Y with a WAC of at least 16 wt %. Suitable methods to obtain such shaped bodies include spray-drying, pelletising, extrusion (optionally combined with kneading), beading, or any other conventional shaping method used in the catalyst and absorbent fields or combinations thereof.

For instance, if the preparation of the Fischer-Tropsch catalyst particles involves a spray-drying step, it is possible to add particles comprising the zeolite Y to the Fischer-Tropsch catalyst before spray-drying and subsequently spray-dry the resulting mixture.

If desired, a matrix or binding material may be added to improve the mechanical strength of the shaped bodies. Examples of suitable matrix or binding materials are alumina, silica, clays, and mixtures thereof. Matrix or binding materials comprising alumina are generally preferred. The matrix or binding material, if present, is preferably present in an amount of 10-40 wt %, more preferably 15-35 wt %, and most preferably 25-35 wt %, based on the total weight of the catalyst composition.

If the particles comprising the zeolite Y and the Fischer-Tropsch catalyst particles are not in the form of shaped bodies in which both particles are embedded, the Fischer-Tropsch catalyst particles and the particles comprising the zeolite Y can be dosed individually—according to need—to the Fischer-Tropsch unit. This creates great flexibility. For instance, if the process conditions change during processing or if one of the catalysts deactivates faster than the other, one of the catalysts may be added at a faster dosing rate than the other.

In addition, is it possible to either use both catalyst components in the second step of the Fishcher-Tropsch process, or use the Fischer-Tropsch catalyst component in the second step and the FCC catalyst component in the third step.

The bulk SAR of the zeolite Y used preferably is above 4.0, more preferably 5.0-10.0.

The particles comprising the zeolite Y may consist for 100% of zeolite Y with a WAC of at least 16 wt %. Preferably, however, the zeolite Y-comprising particles contain additional compounds, such as matrix or binder materials (e.g. silica, alumina, silica-alumina), clay (e.g. kaolin, metakaolin, bentonite), additional zeolites and/or metal compounds.

Examples of suitable metals to be present in the particles comprising the zeolite Y are rare earth metals, e.g. Ce and La, and transition metals of Groups IV-VIII of the Periodic System, e.g. V, Cr, Mn, Fe, Co, Ni, Cu, Zr, Nb, Ru, Re, etc.

The metal compounds can serve to, e.g., increase the particle strength (e.g. La compounds), enhance the catalyst's stability (e.g. Ni compounds), or enhance CO conversion (e.g. Fe, Co, or Ru compounds).

The metal compound is preferably present in or on the zeolite in amounts of 0.1 to 10 wt %, more preferably 0.3 to 2 wt %, calculated as oxide.

The metal compound can be supported on the zeolite Y or the particles comprising the zeolite Y in any manner known in the art. Examples of such methods are impregnation, ion-exchange, and deposition precipitation of soluble metal salts.

If desired, the metal-containing zeolite Y-containing particles are calcined and/or pre-reduced after the metal compound has been deposited.

The Fischer-Tropsch catalyst can be any conventional Fischer-Tropsch catalyst, preferably comprising iron and/or cobalt. For the preparation of such catalysts reference may be had to, e.g., WO 01/97968, WO 01/89686/ and WO 01/70394.

The Fischer-Tropsch catalyst component can be promoted with various metals, e.g. Al, Ti, Cr, Mn, Ca, Na and/or K. Furthermore, the Fischer-Tropsch catalyst component can contain binder materials, such as silica and/or alumina.

Both the particles comprising the zeolite Y and the Fischer-Tropsch catalyst particles can be used in the second step of the Fischer-Tropsch process, either in the form of separate particles, or in the form of shaped bodies in which both particles are embedded. Based on the total weight of particles comprising the zeolite Y and the Fischer-Tropsch catalyst particles, the particles comprising the zeolite Y are preferably used in an amount of 5 to 40 wt %, more preferably from 10 to 30 wt %.

The second step can be carried out in any suitable reactor, such as a (fixed) fluidised bed reactor. The temperature preferably ranges from 250° to 400° C., more preferably from 300° to 370° C., and most preferably from 330° to 350° C. The pressure preferably ranges from 10 to 60 bar, more preferably from 15 to 30 bar, and most preferably is about 20 bar.

The $H_2$/CO volume ratio preferably ranges from 0.2 to 6.0, preferably 0.5-6, most preferably 1-3.

The third step is generally conducted at temperatures of 150 to 600° C., more preferably 200 to 500° C., and most preferably 300 to 400° C. The pressure preferably ranges from 5 to 60 bar, more preferably from 15 to 40 bar, and most preferably from 20 to 30 bar.

The resulting hydrocarbon product preferably contains, on a mass basis, at least 35%, more preferably at least 45%, and most preferably at least 50% of $C_5^+$ compounds. The process may be used for the production of branched hydrocarbons, olefins and/or aromatics. Preferably, the process is used for the production of liquid fuel, especially diesel and gasoline, and preferably unleaded gasoline.

EXAMPLE

The following experiments illustrate the suitability of zeolite-Y with a WAC of at least 16 for the isomerisation of linear olefinic products under typical Fischer-Tropsch process conditions.

Catalysts which are suitable for this purpose can be used either in the second step (as co-catalyst) or in the third step of the Fischer-Tropsch process in order to enhance the isomerisation of the linear olefinic products.

To this end, the performance of the co-catalysts was tested in the hydro-isomerisation of 1-hexene. The reaction conditions (temperature, total pressure, and dihydrogen pressure) for the performance tests were identical to the conditions present in a typical high-temperature Fischer-Tropsch process:

| | |
|---|---|
| Temperature | 340° C. |
| Total Pressure | 20 bar |
| Catalyst intake | 2.2 g |
| WHSV, 1-Hexene | 2.85 g/g/hr (based on zeolite present) |
| $H_2$ Partial pressure | 9 bar |
| $N_2$ Partial pressure | 10.8 bar |
| 1-Hexene Partial pressure | 0.22 bar |
| Mole ratio $H_2$/1-Hexene | 40.9 |
| Mole ratio $N_2$/1-Hexene | 49.1 |

The co-catalysts were reduced in situ in the reactor under 20 bar hydrogen pressure 340° C. for 1 hr. After the reduction procedure was completed, the nitrogen flow was introduced and subsequently 1-hexene was dosed (0.11 ml/min). The composition of the reaction product was followed by on-line GC analysis.

Three different zeolite Y-containing co-catalysts were tested according to this procedure: one consisting of zeolite-Y and an alumina binder (Y/Al), another consisting of zeolite-Y, an alumina binder, and 0.5 wt % nickel (Ni/Y/Al), and the third consisting of zeolite-Y, an alumina binder, and 0.5 wt % cobalt (Co/Y/Al). Nickel and cobalt were introduced into the zeolite Y/alumina composition by impregnation.

The WAC ($p/p_0$=0.2, 25° C.) of the used zeolite Y was 17 wt %, the bulk SAR was 7, the framework SAR was 10.

The product distribution obtained in these tests at 0.5 hr and at 17.5 hr runtime is presented in Tables 1 and 2, respectively.

In these Tables, n-$C_6$ refers to normal $C_6$ paraffins, i-$C_6$ refers to branched $C_6$ paraffins, n-$C_6$=refers to normal $C_6$ olefins, i-$C_6$=refers to branched $C_6$ olefins, and <$C_6$ and >$C_6$ refer to compounds with less and more than 6 carbon atoms, respectively.

TABLE 1 test results at 0.5 hr runtime

| | Y/Al | Ni/Y/Al | Co/Y/Al |
|---|---|---|---|
| Conversion 1-hexene, wt % | 94.9 | 94.2 | 91.9 |
| n-$C_6$, wt % | 21.0 | 7.5 | 6.3 |
| i-$C_6$, wt % | 23.7 | 29.1 | 17.2 |
| n-$C_6$=, wt % | 12.6 | 16.3 | 26.2 |
| i-$C_6$=, wt % | 24.4 | 26.6 | 36.2 |
| <$C_6$, wt % | 12.4 | 13.2 | 8.9 |
| >$C_6$, wt % | 6.2 | 7.5 | 5.5 |
| i-$C_6$ + i-$C_6$=, wt % | 48.1 | 55.7 | 53.4 |

TABLE 2 test results at 17.5 hr runtime

| | Y/Al | Ni/Y/Al | Co/Y/Al |
|---|---|---|---|
| Conversion 1-hexene, wt % | 91.2 | 91.5 | 90.4 |
| n-$C_6$, wt % | 10.9 | 8.4 | 6.3 |
| i-$C_6$, wt % | 10.9 | 12.8 | 9.4 |
| n-$C_6$=, wt % | 27.1 | 23.2 | 35.1 |
| i-$C_6$=, wt % | 40.8 | 40.3 | 41.9 |
| <$C_6$, wt % | 5.4 | 8.8 | 3.5 |
| >$C_6$, wt % | 5.6 | 6.8 | 4.1 |
| i-$C_6$ + i-$C_6$=, wt % | 51.7 | 53.1 | 51.3 |

As can be seen from these tables, the zeolite Y/alumina composition without added metals has a high selectivity to branched $C_6$ olefins (i-$C_6$=) and branched $C_6$ paraffins (i-$C_6$).

The total amounts of isomerised products at 0.5 hr and 17.5 hr runtime were 48.1 wt % and 51.6 wt %, respectively. This high isomerisation selectivity was accompanied by a low level of cracking: only 5.4 wt % of products smaller than $C_6$ ($<C_6$) were obtained at 17.5 hr runtime. The amount of aromatic products was far below 1 wt % during the whole run.

The nickel impregnated composition showed a higher selectivity to branched $C_6$ olefins (i-$C_6$=) and branched $C_6$ paraffins (i-$C_6$) than the non-impregnated composition. The total amounts of isomerised products at 0.5 hr and 17.5 hr runtime were 55.6 wt % and 53.05 wt %, respectively. The level of cracking was 8.8 wt % at 17.5 hr runtime. The amount of aromatic products was far below 1 wt % during the whole run.

The cobalt impregnated composition gave total amounts of isomerised products at 0.5 hr and 17.5 hr runtime of 53.4 wt % and 51.2 wt %, respectively. The level of cracking at 17.5 hr runtime was 3.0 wt %. Again, the amount of aromatic products was far below 1 wt % during the whole run.

These experiments show that zeolite Y with a WAC of at least 16 is able to isomerise linear olefinic hydrocarbons under typical Fischer-Tropsch conditions. This indicates their suitability for use in the second and third steps of the Fischer-Tropsch process.

The invention claimed is:

1. A process for the conversion of carbon monoxide and hydrogen to C5+ hydrocarbon mixtures using a catalyst composition comprising distinct Fischer-Tropsch catalyst particles and distinct catalyst particles comprising zeolite Y with a water adsorption capacity (25 C, p/po=0.20) of at least 16 wt %, wherein the particles comprising zeolite Y have not been impregnated with a metal having Fischer-Tropsch activity.

2. The process according to claim 1 wherein the Fischer-Tropsch catalyst particles and the particles comprising zeolite Y are dosed to the reaction mixture individually.

3. The process according to claim 2 wherein the Fischer-Tropsch catalysts particles and the particles comprising zeolite Y are dosed at different rates.

4. The process according to claim 1 wherein the Fischer-Tropsch catalyst particles and the particles comprising zeolite Y are used in the form of shaped bodies in which both particles are embedded.

5. The process according to claim 1 wherein the Fischer-Tropsch catalyst particles comprise iron.

6. The process according to claim 1 wherein the Fischer-Tropsch catalyst particles comprise cobalt.

7. The process according to claim 1 wherein a metal compound other than a metal compound having Fischer-Tropsch activity has been deposited in or on the particles comprising zeolite Y.

* * * * *